US007500364B2

(12) United States Patent
Schumacher et al.

(10) Patent No.: US 7,500,364 B2
(45) Date of Patent: Mar. 10, 2009

(54) SYSTEM FOR COUPLING FLOW FROM A CENTRIFUGAL COMPRESSOR TO AN AXIAL COMBUSTOR FOR GAS TURBINES

(75) Inventors: Jurgen C. Schumacher, Phoenix, AZ (US); Frank J. Zupanc, Phoenix, AZ (US); Paul R. Yankowich, Phoenix, AZ (US); Rodolphe Dudebout, Phoenix, AZ (US); Michael T. Barton, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 595 days.

(21) Appl. No.: 11/286,102

(22) Filed: Nov. 22, 2005

(65) Prior Publication Data

US 2007/0113557 A1 May 24, 2007

(51) Int. Cl.
*F23R 3/04* (2006.01)

(52) U.S. Cl. ..... 60/751; 60/752

(58) Field of Classification Search ..... 60/726, 60/751, 752, 756, 804
See application file for complete search history.

(56) References Cited

U.S. PATENT DOCUMENTS

| | | | | |
|---|---|---|---|---|
| 2,726,508 | A | 12/1955 | Halford et al. | |
| 2,853,227 | A | 9/1958 | Beardsley | |
| 3,793,827 | A | 2/1974 | Ekstedt | |
| 4,081,957 | A * | 4/1978 | Cox | 60/751 |
| 4,100,732 | A | 7/1978 | Bryans et al. | |
| 4,251,183 | A | 2/1981 | Liu et al. | |
| 4,455,121 | A * | 6/1984 | Jen | 60/751 |
| 4,993,220 | A | 2/1991 | Shekleton et al. | |
| 5,109,671 | A | 5/1992 | Haasis | |
| 5,165,226 | A | 11/1992 | Newton et al. | |
| 5,335,502 | A | 8/1994 | Roberts, Jr. et al. | |
| 5,537,814 | A | 7/1996 | Nastuk et al. | |
| 5,555,721 | A | 9/1996 | Bourneuf et al. | |

(Continued)

FOREIGN PATENT DOCUMENTS

EP 0564171 A1 10/1993

(Continued)

OTHER PUBLICATIONS

EP Search Report, 06124379.6-2301 dated Jul. 15, 2008.

*Primary Examiner*—Louis J Casaregola
(74) *Attorney, Agent, or Firm*—Ingrassia Fisher & Lorenz, P.C.

(57) ABSTRACT

A system is provided for aerodynamically coupling air flow from a centrifugal compressor to an axial combustor. The system includes a diffuser, a deswirl assembly, combustor inner and outer annular liners, a combustor dome, and a curved annular plate. The diffuser has an inlet that communicates with the centrifugal compressor, an outlet, and a flow path that extends radially outward. The deswirl assembly has an inlet that communicates with the diffuser outlet to receive air flowing in a radially outward direction, an outlet, and a flow path configured to redirect the air in a radially inward and axial direction through the deswirl assembly outlet at an angle toward a longitudinal axis. The curved annular plate is coupled to combustor inner and outer annular liner upstream ends to form a combustor subplenum therebetween and has a first opening and a second opening formed therein, the first opening aligned with the deswirl assembly outlet to receive air discharged therefrom.

10 Claims, 4 Drawing Sheets

U.S. PATENT DOCUMENTS

| | | | | |
|---|---|---|---|---|
| 5,735,115 | A | 4/1998 | Maghon | |
| 5,997,244 | A | 12/1999 | Gebre-Giorgis et al. | |
| 6,276,896 | B1 | 8/2001 | Burge et al. | |
| 6,279,322 | B1 | 8/2001 | Moussa | |
| 6,546,733 | B2 * | 4/2003 | North et al. | 60/756 |
| 6,585,482 | B1 | 7/2003 | Liotta et al. | |
| 6,920,762 | B2 | 7/2005 | Wells et al. | |
| 2005/0118019 | A1 | 6/2005 | Roberts et al. | |
| 2005/0132716 | A1 | 6/2005 | Zupanc et al. | |

FOREIGN PATENT DOCUMENTS

| | | | |
|---|---|---|---|
| EP | 1271059 | A2 | 1/2003 |
| WO | 2004055439 | A1 | 7/2004 |

* cited by examiner

SYSTEM FOR COUPLING FLOW FROM A CENTRIFUGAL COMPRESSOR TO AN AXIAL COMBUSTOR FOR GAS TURBINES

TECHNICAL FIELD

The present invention relates to gas turbine engines and, more particularly, to a system for coupling airflow from a centrifugal compressor to an axial combustor.

BACKGROUND

A gas turbine engine may be used to power various types of vehicles and systems. A particular type of gas turbine engine that may be used to power aircraft is a turbofan gas turbine engine. A turbofan gas turbine engine may include, for example, five major sections, a fan section, a compressor section, a combustor section, a turbine section, and an exhaust section. The fan section is positioned at the front, or "inlet" section of the engine, and includes a fan that induces air from the surrounding environment into the engine, and accelerates a fraction of this air toward the compressor section. The remaining fraction of air induced into the fan section is accelerated into and through a bypass plenum, and out the exhaust section.

The compressor section raises the pressure of the air it receives from the fan section to a relatively high level. In a multi-spool engine, the compressor section may include two or more compressors, such as, for example, a high pressure compressor and a low pressure compressor. The compressed air from the compressor section then enters the combustor section, where a ring of fuel nozzles injects a steady stream of fuel into a plenum formed by liner walls and a dome. The injected fuel is ignited in the combustor, which significantly increases the energy of the compressed air. The high-energy compressed air from the combustor section then flows into and through the turbine section, causing rotationally mounted turbine blades to rotate and generate energy. The air exiting the turbine section is exhausted from the engine via the exhaust section, and the energy remaining in the exhaust air aids the thrust generated by the air flowing through the bypass plenum.

In some engines, the compressor section is implemented with a centrifugal compressor. A centrifugal compressor typically includes at least one impeller that is rotationally mounted to a rotor and surrounded by a shroud. When the impeller rotates, it compresses the air received from the fan section and the shroud directs the air radially outward into a diffuser. The diffuser decreases the velocity and increases the static pressure of the air and directs the air into a deswirl assembly, which straightens the flow of the air before it enters the combustor section. The combustor section in some engines is implemented with an axial through-flow combustor that includes an annular combustor disposed within a combustor housing that defines a plenum. The straightened air enters the plenum and travels axially through the annular combustor where it is mixed with fuel and ignited.

Aerodynamic coupling of the components in a gas turbine engine affects engine performance, operability and efficiency. To achieve optimal performance for a system including a centrifugal compressor, the discharge flow from the centrifugal compressor is preferably suitably conditioned, the compressor discharge flow has minimal losses as it enters the combustor plenum, and maximum static pressure recovery is preferably achieved at the dome and liner walls of the combustor. Additionally, because the flow changes direction from radial to axial and transitions from a larger to a smaller radial area as it enters the turbine, the flow is preferably conditioned to a low mach number for combustor and system performance. However, when an axial through-flow combustor is used in conjunction with the centrifugal compressor, misalignment between the compressor discharge and turbine inlet may undesirably occur, which may pose challenges to satisfying performance requirements.

Hence, there is a need for efficient methods to aerodynamically couple a centrifugal compressor and an axial through-flow combustor which suitably directs and conditions the air flow for optimal performance.

BRIEF SUMMARY

The present invention provides a system for aerodynamically coupling air flow from a centrifugal compressor to an axial combustor, where the compressor and combustor are disposed about a longitudinal axis, using a vectored deswirl assembly in concert with a dome shroud attachment.

In one embodiment, and by way of example only, the system includes a diffuser, a deswirl assembly, combustor inner and outer annular liners, a combustor dome, and a curved annular plate. The diffuser has an inlet, an outlet and a flow path extending therebetween. The diffuser inlet is in flow communication with the centrifugal compressor, and the diffuser flow path extends radially outward from the longitudinal axis. The deswirl assembly has an inlet, an outlet and a flow path extending therebetween. The deswirl assembly inlet is in flow communication with the diffuser outlet to receive air flowing in a radially outward direction, and the deswirl assembly flow path is configured to redirect the air in a radially inward and axial direction through the deswirl assembly outlet at an angle toward the longitudinal axis. The combustor inner annular liner is disposed about the longitudinal axis and has an upstream end. The combustor outer annular liner is disposed concentric to the combustor inner annular liner and forms a combustion plenum therebetween and has an upstream end. The combustor dome is coupled to and extends between the combustor inner and outer annular liner upstream ends. The curved annular plate is coupled to the combustor inner and outer annular liner upstream ends to form a combustor subplenum therebetween. The curved annular plate has a first opening and a second opening formed therein, the first opening aligned with the deswirl assembly outlet to receive air discharged therefrom.

In another embodiment, and by way of example only, a gas turbine engine disposed about a longitudinal axis is provided. The engine includes a centrifugal compressor, a diffuser, a deswirl assembly, and a combustor. The centrifugal compressor comprises a compressor housing, an impeller disposed in the compressor housing and configured to rotate about the longitudinal axis, and a shroud disposed around the impeller. The diffuser has an inlet, an outlet and a flow path extending therebetween. The diffuser inlet is in flow communication with the centrifugal compressor, and the diffuser flow path extends radially outward from the longitudinal axis. The deswirl assembly has an inlet, an outlet and a flow path extending therebetween. The deswirl assembly inlet is in flow communication with the diffuser outlet and configured to receive air flowing in a radially outward direction. The deswirl assembly flow path curves from the deswirl assembly inlet to the deswirl assembly outlet and is configured to redirect the air into a radially inward and axial direction through the deswirl assembly outlet at an angle toward the longitudinal axis. The combustor is coupled to the centrifugal compressor and includes a combustor housing, combustor inner and outer annular liners, a combustor dome, and a curved annular plate. The combustor housing is coupled to the compressor housing. The combustor inner annular liner is disposed in the combustor housing about the longitudinal axis, and the inner annular liner has an upstream end. The combustor outer annular liner is disposed concentric to the combustor inner annular liner, forms a combustion plenum therebetween, and has an upstream end. The combustor dome is coupled to and extends between the combustor inner and outer annular liner upstream ends. The curved annular plate is coupled to the combustor inner and outer annular liner upstream ends to form a combustor subplenum therebetween. The curved annular plate has a first opening and a second opening formed therein, the first opening aligned with the deswirl assembly outlet to receive air discharged therefrom.

In another exemplary embodiment, a dome shroud assembly is provided to aerodynamically couple a combustor and a deswirl assembly, where the combustor has an inner annular liner, an outer annular liner disposed concentric to the inner annular liner, and a plurality of fuel injectors, the inner and outer annular liners having upstream ends, and the deswirl assembly having an outlet for discharging air. The dome shroud assembly includes a curved annular plate and first and second pluralities of openings. The curved annular plate is coupled to the combustor inner and outer annular liner upstream ends to form a combustor subplenum therebetween. The first plurality of openings is formed in the curved annular plate in a substantially circular pattern having a first radius, and each opening of the first plurality of openings is aligned with the deswirl assembly outlet and configured to receive air discharged therefrom. The second plurality of openings is formed in the curved annular plate in a substantially circular pattern having a second radius, and each opening of the second plurality of openings is configured to allow at least one fuel injector to extend therethrough.

Other independent features and advantages of the preferred coupling system will become apparent from the following detailed description, taken in conjunction with the accompanying drawings which illustrate, by way of example, the principles of the invention.

DETAILED DESCRIPTION OF A PREFERRED EMBODIMENT

Before proceeding with the detailed description, it is to be appreciated that the described embodiment is not limited to use in conjunction with a particular type of turbine engine. Thus, although the present embodiment is, for convenience of explanation, depicted and described as being implemented in a multi-spool turbofan gas turbine jet engine, it will be appreciated that it can be implemented in various other types of turbines, and in various other systems and environments.

Figure 1:
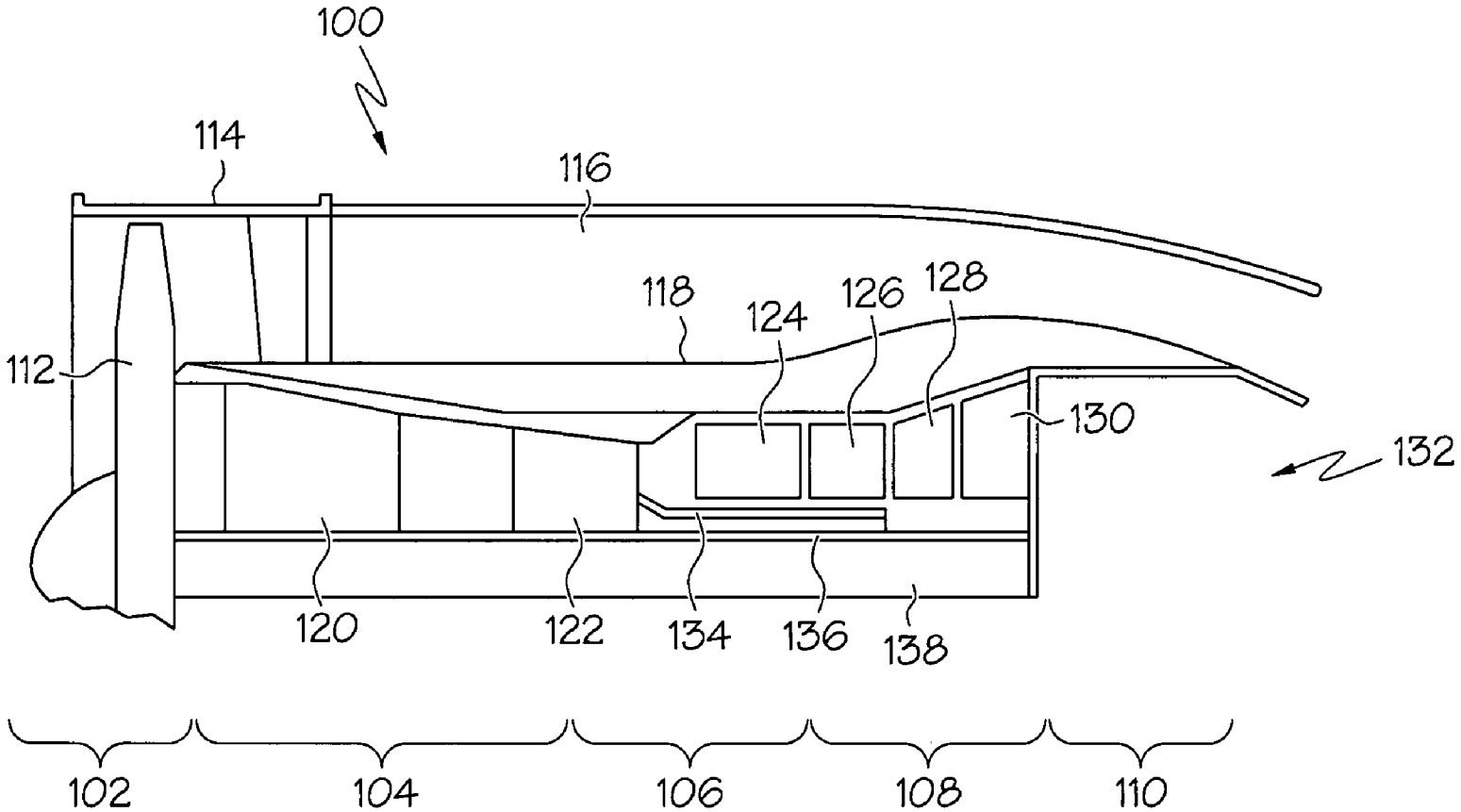
FIG. 1 is a simplified cross section side view of an exemplary multi-spool turbofan gas turbine jet engine according to an embodiment of the present invention.

An exemplary embodiment of a multi-spool turbofan gas turbine jet engine 100 is depicted in FIG. 1, and includes an intake section 102, a compressor section 104, a combustion section 106, a turbine section 108, and an exhaust section 110. The intake section 102 includes a fan 112, which is mounted in a fan case 114. The fan 112 draws air into the intake section 102 and accelerates it. A fraction of the accelerated air exhausted from the fan 112 is directed through a bypass section 116 disposed between the fan case 114 and an engine cowl 118, and provides a forward thrust. The remaining fraction of air exhausted from the fan 112 is directed into the compressor section 104.

The compressor section 104 includes two compressors, an intermediate pressure compressor 120, and a high pressure compressor 122. The intermediate pressure compressor 120 raises the pressure of the air directed into it from the fan 112, and directs the compressed air into the high pressure compressor 122. The high pressure compressor 122 compresses the air still further, and directs the high pressure air into the combustion section 106. In the combustion section 106, which includes an annular combustor 124, the high pressure air-is mixed with fuel and combusted. The combusted air is then directed into the turbine section 108.

The turbine section 108 includes three turbines disposed in axial flow series, a high pressure turbine 126, an intermediate pressure turbine 128, and a low pressure turbine 130. The combusted air from the combustion section 106 expands through each turbine, causing it to rotate. The air is then exhausted through a propulsion nozzle 132 disposed in the exhaust section 110, providing addition forward thrust. As the turbines rotate, each drives equipment in the engine 100 via concentrically disposed shafts or spools. Specifically, the high pressure turbine 126 drives the high pressure compressor 122 via a high pressure spool 134, the intermediate pressure turbine 128 drives the intermediate pressure compressor 120 via an intermediate pressure spool 136, and the low pressure turbine 130 drives the fan 112 via a low pressure spool 138.

Figure 2:
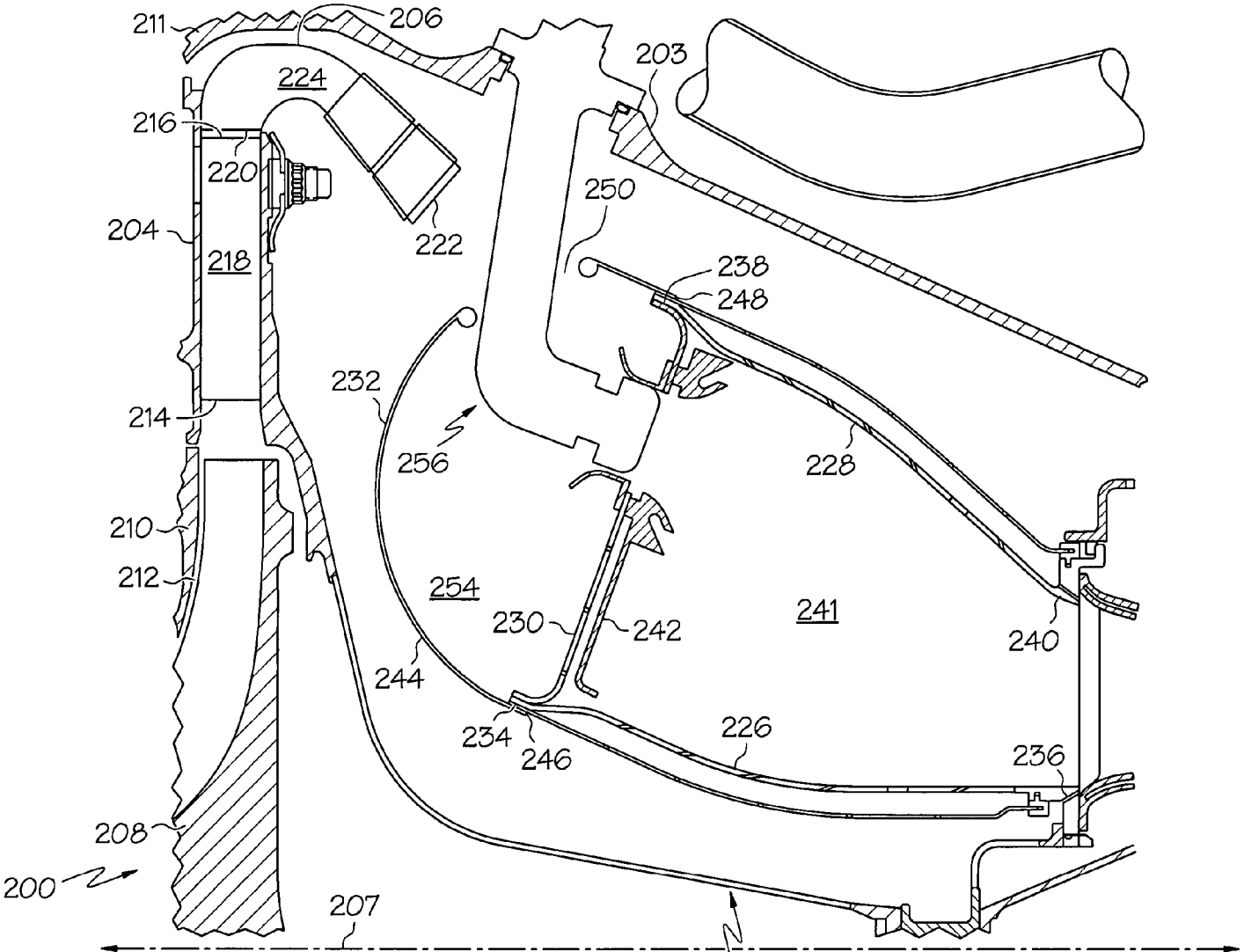
FIGS. 2 and 3 are cross section views of a portion of an exemplary combustor that may be used in the engine of FIG. 1, and that show, respectively, a main fuel injector and pilot fuel injector assembly.
Figure 3:
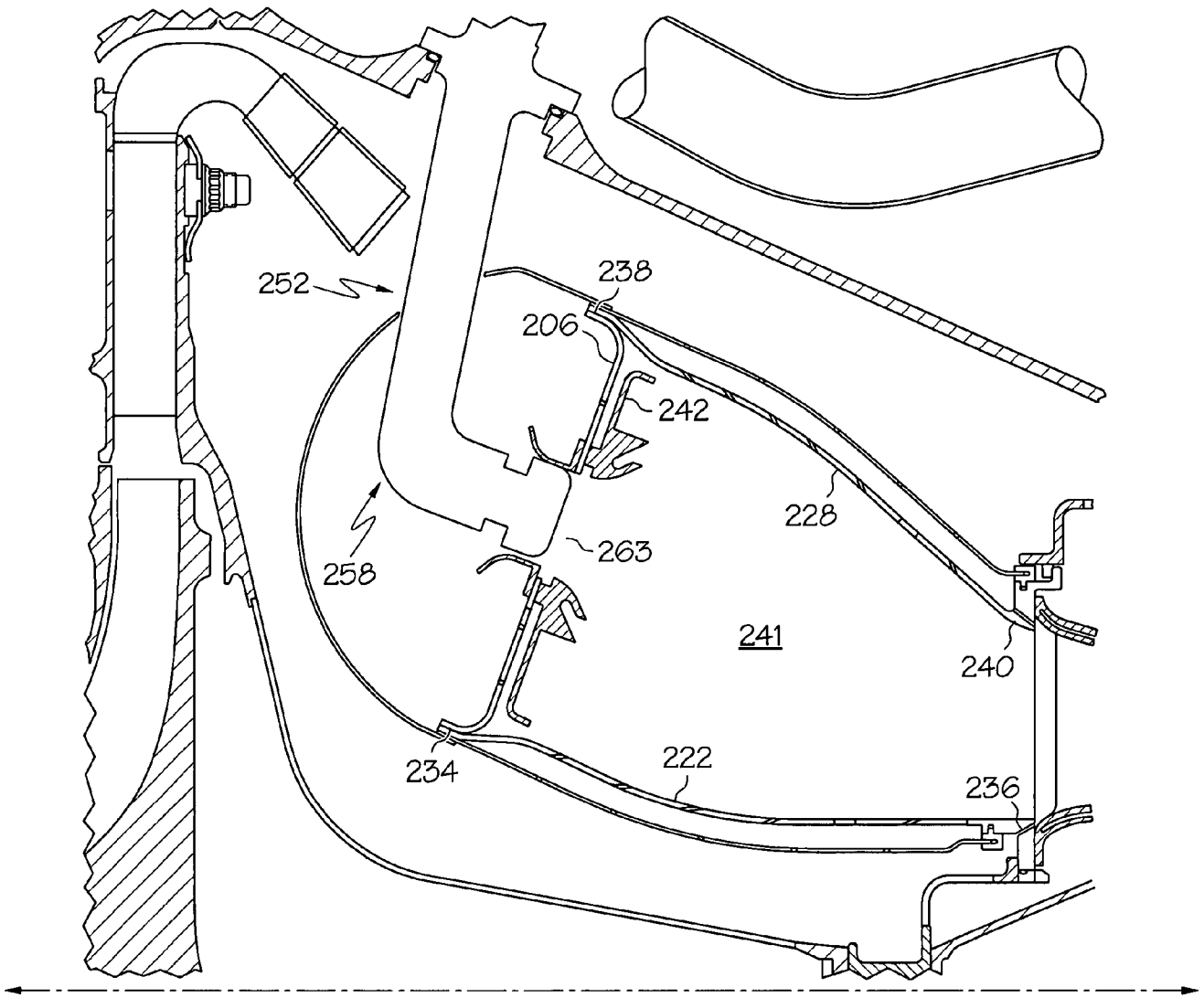

Turning now to FIGS. 2 and 3, cross sections of the area between an exemplary high pressure compressor 200 and annular combustor 202 are illustrated. In addition to the compressor 200 and combustor 202, FIGS. 2 and 3 depict a diffuser 204 and a deswirl assembly 206, each disposed about a longitudinal axis 207. The high pressure compressor 200 is a centrifugal compressor and includes an impeller 208 and a shroud 210 disposed in a compressor housing 211. The impeller 208, as alluded to above, is driven by the high pressure turbine 126 and rotates about the longitudinal axis 207. The shroud 210 is disposed around the impeller 208 and defines an impeller discharge flow passage 212 therewith that extends radially outwardly.

The diffuser 204 is coupled to the shroud 210 and is configured to decrease the velocity and increase the static pressure of air that is received therefrom. In this regard, any one of numerous conventional diffusers 204 suitable for operating with a centrifugal compressor may be employed. In any case, the diffuser 204 includes an inlet 214, an outlet 216, and a flow path 218 that each communicates with the passage 212, and the flow path 218 is configured to direct the received air flow radially outwardly.

The deswirl assembly 206 communicates with the diffuser 204 and is configured to substantially remove swirl from air received therefrom, which decreases the Mach number of the air flow. The deswirl assembly 206 includes an inlet 220, an outlet 222, and a flow path 224 that extends therebetween. Preferably, the flow path 224 is configured to receive the radially directed air that is discharged from the diffuser 204 and change its direction. More specifically, the flow path 224 is preferably configured to redirect the air from its radially outward direction to a radially inward and axially downstream direction. Thus, the flow path 224 preferably extends between the inlet 220 and outlet 222 in an arc so that when the air exits the outlet 222, it is directed at an angle and toward the longitudinal axis 207 and the annular combustor 202.

The annular combustor 202 is housed in a combustor housing 203 that is coupled to the compressor housing 211 and includes an inner annular liner 226, an outer annular liner 228, a combustor dome 230, and a dome shroud assembly 232. The inner annular liner 226 includes an upstream end 234 and a downstream end 236. Similarly, the outer annular liner 228, which surrounds the inner annular liner 226, includes an upstream end 238 and a downstream end 240. The combustor dome 230 is coupled between the inner and outer annular liner upstream ends 234, 238, respectively, forming a combustion plenum 241 between the inner and outer annular liners 226, 228. In the depicted embodiment, a heat shield 242 is coupled to the combustor dome 230, though it will be appreciated that the heat shield 242 could be eliminated. It will additionally be appreciated that although the inner and outer annular liners 226, 228 in the depicted embodiment are of a double-walled construction, the liners 226, 228 could also be a single-walled construction.

The dome shroud assembly 232 receives air that is discharged from the deswirl assembly 206 and minimizes extreme cross-flow velocites of the received air at the combustor dome 230 surface. Additionally, the dome shroud assembly 232 is configured to recover a portion of the dynamic head in the air flow to transform the head to static pressure. The dome shroud assembly 232 includes a curved annular plate 244 that has inner and outer annular edges 246, 248 and a plurality of openings 250, 252 (shown in more clearly in FIG. 4). The inner and outer annular edges 246, 248 are coupled to the inner and outer annular liner upstream ends 234, 238 to form a combustor subplenum 254. The combustor subplenum 254 provides a space within which air discharges from the deswirl assembly 206 is received and within which a plurality of fuel injector assemblies 232, 256 are disposed.

The openings 250, 252 are formed in the annular plate 244 between the inner and outer annular edges 246, 248, and may be variously sized or shaped. One set of openings 250 is configured to be aligned with the deswirl assembly outlet 222 and to receive air exiting therefrom. Preferably, the placement of each opening 250 is optimized such that a maximum amount of air is captured in the combustor subplenum 254. In one exemplary embodiment, some of the openings 250 may also be configured to allow extension of one or more of the fuel injector assemblies 232, 256 therethrough. The other set of openings 252 may be configured to allow fuel injector assemblies 232, 256 to extend therethrough.

Figure 4:
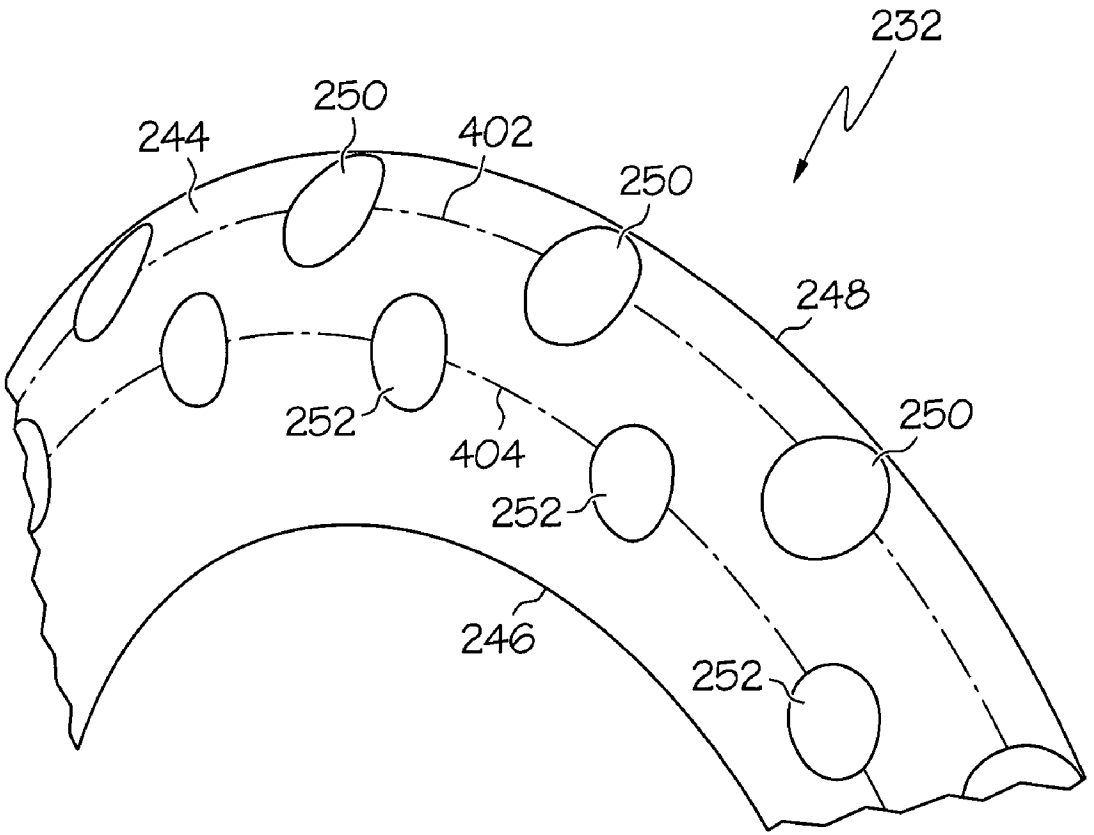
FIG. 4 is an isometric view of a portion of an exemplary dome shroud assembly that may be implemented into the combustor shown in FIGS. 2 and 3.

In one exemplary embodiment, the two sets of openings 250, 252 may be formed on the annular plate 244 at different radial and circumferential locations. For example, as shown in FIG. 4, the first set of openings 250 may be disposed in a first substantially circular pattern having a first radius 402 and the second set of openings 252 may be disposed in a second substantially circular pattern having a second radius 404. The openings 250 may be substantially evenly spaced apart from one another. In the depicted embodiment, the first radius 402 is greater than the second radius 404, though it will be appreciated that the annular plate 244 is not limited to this configuration. In another alternative embodiment, the openings 250, 252 are disposed in an alternating arrangement along their respective radii. More specifically, the openings of the first set of openings 250 are circumferentially interspersed among the openings of the second set of openings 252.

Returning to FIGS. 2 and 3, two types of fuel injector assemblies extend through the dome shroud assembly 232, specifically, pilot fuel injector assemblies 256 (see FIG. 2) and main fuel injector assemblies 258 (see FIG. 3). Each fuel injector assembly 256, 258 is coupled to the combustor dome 230. It will be appreciated that, for clarity, only one fuel injector assembly type is shown in each of FIGS. 2 and 3.

During engine operation, the high pressure compressor 200 is rotated and compresses air it receives therefrom. The air is directed radially outwardly through the passage 212 into the diffuser 204 and the deswirl assembly 206. The deswirl assembly 206 forces the air into an inward and axial flow into the combustor subplenum 254 via one or more openings of the first set of openings 250. Then, the air enters the swirler assemblies and fuel is sprayed into the air via the fuel injector assemblies 256, 258. The fuel/air mixture is then mixed and directed into the combustion plenum 241 to be ignited.

There has now been provided a gas turbine engine that operates more efficiently. Additionally, the engine is relatively inexpensive and simple to implement into existing aircraft configurations wherein a centrifugal compressor is mounted with an axial combustor.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A system for aerodynamically coupling air flow from a centrifugal compressor to an axial combustor, the compressor and combustor disposed about a longitudinal axis, the system comprising:

a diffuser having an inlet, an outlet and a flow path extending therebetween, the diffuser inlet in flow communication with the centrifugal compressor, and the diffuser flow path extending radially outward from the longitudinal axis;

a deswirl assembly having an inlet, an outlet and a flow path extending therebetween, the deswirl assembly inlet in flow communication with the diffuser outlet to receive air flowing in a radially outward direction, and the deswirl assembly flow path configured to redirect the air in a radially inward and axial direction through the deswirl assembly outlet at an angle toward the longitudinal axis;

a combustor inner annular liner disposed about the longitudinal axis, the inner annular liner having an upstream end;

a combustor outer annular liner disposed concentric to the combustor inner annular liner and forming a combustion plenum therebetween, the outer annular liner having an upstream end;

a combustor dome coupled to and extending between the combustor inner and outer annular liner upstream ends; and a curved annular plate coupled to the combustor inner and outer annular liner upstream ends to form a combustor subplenum therebetween, the curved annular plate having a first opening and a second opening formed therein, the first opening aligned with the deswirl assembly outlet to receive air discharged therefrom.

2. The system of claim 1, the system further comprising:

a fuel injector extending through the curved annular plate second opening and disposed at least partially in the combustion plenum.

3. The system of claim 1, wherein the first and second openings have different shapes.

4. The system of claim 1, wherein the deswirl assembly flowpath is arcuate.

5. The system of claim 1, wherein the combustor dome includes an opening formed therethrough.

6. A gas turbine engine disposed about a longitudinal axis, the engine comprising:

a centrifugal compressor comprising:

a compressor housing;

an impeller disposed in the compressor housing and configured to rotate about the longitudinal axis; and a shroud disposed around the impeller;

a diffuser having an inlet, an outlet and a flow path extending therebetween, the diffuser inlet in flow communication with the centrifugal compressor, and the diffuser flow path extending radially outward from the longitudinal axis;

a deswirl assembly having an inlet, an outlet and a flow path extending therebetween, the deswirl assembly inlet in flow communication with the diffuser outlet and configured to receive air flowing in a radially outward direction, and the deswirl assembly flow path curving from the deswirl assembly inlet to the deswirl assembly outlet and configured to redirect the air into a radially inward and axial direction through the deswirl assembly outlet at an angle toward the longitudinal axis; and a combustor coupled to the centrifugal compressor comprising:

a combustor housing coupled to the compressor housing;

a combustor inner annular liner disposed in the combustor housing about the longitudinal axis, the inner annular liner having an upstream end;

a combustor outer annular liner disposed concentric to the combustor inner annular liner and forming a combustion plenum therebetween, the outer annular liner having an upstream end;

a combustor dome coupled to and extending between the combustor inner and outer annular liner upstream ends; and a curved annular plate coupled to the combustor inner and outer annular liner upstream ends to form a combustor subplenum therebetween, the curved annular plate having a first opening and a second opening, the first opening formed therein and aligned with the deswirl assembly outlet to receive air discharged therefrom.

7. The engine of claim 6, further comprising:

a fuel injector disposed at least partially in the combustion plenum and extending through the curved annular plate second opening.

8. The engine of claim 6, wherein the first and second openings have different shapes.

9. The engine of claim 6, wherein the deswirl assembly flowpath is arcuate.

10. The engine of claim 6, wherein the combustor dome includes an opening formed therethrough.

* * * * *